US006401345B1

(12) United States Patent
Liaw

(10) Patent No.: US 6,401,345 B1
(45) Date of Patent: Jun. 11, 2002

(54) TOOL HEAD FOR A DUAL PUNCH TOOL

(75) Inventor: Jian-Shiou Liaw, Taichung (TW)

(73) Assignee: K.K.U. Limited, Tokyo (JP)

( * ) Notice: Subject to any disclaimer, the term of this patent is extended or adjusted under 35 U.S.C. 154(b) by 0 days.

(21) Appl. No.: 09/545,239

(22) Filed: Apr. 7, 2000

(30) Foreign Application Priority Data

May 29, 1999 (TW) ..... 88208728 U

(51) Int. Cl.[7] ..... B26F 1/00
(52) U.S. Cl. ..... 30/364; 30/362; 30/358
(58) Field of Search ..... 30/362, 364, 361, 30/360, 358; 83/685, 687, 691

(56) References Cited

U.S. PATENT DOCUMENTS 3,008,234 A * 11/1961 Mattera ..... 30/358
4,583,438 A * 4/1986 Kane ..... 83/555
RE33,798 E * 1/1992 Waltonen ..... 83/615
5,095,618 A * 3/1992 Dacey, Jr. ..... 30/362
5,390,575 A * 2/1995 Saito ..... 83/522
5,622,076 A * 4/1997 Welty ..... 72/453.15
5,630,277 A * 5/1997 Kimura ..... 30/362
5,974,926 A * 11/1999 Kimura ..... 83/618

* cited by examiner

*Primary Examiner*—M. Rachuba
*Assistant Examiner*—Kim Ngoc Tran
(74) *Attorney, Agent, or Firm*—Greer, Burns & Crain, Ltd.

(57) ABSTRACT

A hand held hole punching device having a shaft and a main body with a device for axially moving the shaft in a reciprocating motion. The tool head is connected to the shaft and includes a fixed portion fixed to the main body to slidably engage the shaft so that the shaft is permitted to slide axially relative to the fixed portion. Also, a movable portion is fixed to the shaft so that the movable portion moves axially with the shaft and the movable portion and the fixed portion cooperatively define at least two hole punchers. Each hole puncher has a punch pin that is different from a punch pin of any other hole puncher on the tool head.

14 Claims, 6 Drawing Sheets

TOOL HEAD FOR A DUAL PUNCH TOOL

BACKGROUND

The present invention generally relates to a tool head for a dual punch tool such as a pneumatic punch. More particularly, the invention relates to a tool head having two different punch pins operably provided therein.

Pneumatic punches are small hand-held tools used for machining. As shown in FIGS. 5 and 6, a conventional pneumatic punch 50 typically has a tool head 60 provided on a movable shaft 55, which is movable in an axial direction thereof. The tool head 60 comprises an L-shaped fixed seat 61 and an inverted L-shaped movable seat 65 mated with the fixed seat 61. The fixed seat 61 is fixedly mounted on a main body 50*a* of the pneumatic punch 50 and defines an aperture 610 therein to permit the movable shaft 55 to extend therethrough, and further defines a receiving recess or groove 62 to receive a punch pin 63 and an elastic element 64 provided around the punch pin 63. A side cover 70 securely mounted on a top opening 62*a* of the receiving recess 62 limits the lateral movement of the punch pin 63 and the elastic element 64. The movable seat 65 defines a screw hole 650 corresponding to the aperture 610 of the fixed seat 61 to be fixed to a threaded end of the moving shaft 55. The movable seat 65 also defines a discharging passage 66 corresponding to the punch pin 63. A transverse slot groove 67 is defined in the movable seat 65 and is substantially perpendicular to the discharging passage 66. The discharging passage 66 has two opposite openings 67*a*, 67*b* in communication with the transverse slot 67 respectively provided with a first guide cylinder 68 and a second guide cylinder 69.

In operation, and as shown in FIG. 6, when a sheet plate 72 is inserted for punching into the transverse groove 67, and between the first guide cylinder 68 and the second guide cylinder 69, the pneumatic punch 50 is actuated to retract the moving shaft 55. This action draws the movable seat 65 toward the fixed seat 61. Accordingly, the punch pin 63 is inserted through the second guide cylinder 69 into the first guide cylinder 68. A waste sheet 74 punched off the sheet plate 72 is discharged via the discharging passage 66.

However, the conventional pneumatic punch 50 only has one punch pin 63 provided to punch only one type or size of punched hole in a sheet plate, though other conventional devices are believed to also have a flange, or the like. If a work piece needs to be punched with two different hole sizes, for example, the punch pin 63 of the conventional tool head 60 of the pneumatic punch 50 must be changed or replaced frequently, or a second pneumatic size punch 50 with a different punch pin must be available.

Accordingly, it is an objective of the present invention to provide an improved tool head of a hole punching device that can punch two different sizes or types of holes in a work piece by repositioning a single tool head.

These and other objects, advantages and novel features of the present invention are discussed or will be apparent in the detailed description of the invention.

SUMMARY OF THE INVENTION

In keeping with one aspect of the present invention, a hand-held, hole punching device has a shaft, a main body with a device for axially moving the shaft in a reciprocating motion and a tool head connected to the shaft. The tool head includes a fixed portion on the main body for slidably engaging the shaft so that the fixed portion permits the shaft to slide axially relative to the fixed portion. The tool head also has a movable portion secured to the shaft so that the movable portion moves axially with the shaft. The movable portion and the fixed portion cooperatively define at least two hole punchers. Each hole puncher has a punch pin that is different from a punch pin of any other hole puncher on the tool head.

In another aspect of the present invention, the hole punching device also includes a fixed portion that is configured with a generally upright J-shaped formation and a movable portion that is configured with a generally inverted J-shaped formation. The portions are then disposed relative to each other so that the fixed portion impedes axial motion of the movable portion.

In yet another aspect of the present invention, the hole punching device further includes a fixed portion with an axially extending guide block and a movable portion with an axially extending guide slot configured and disposed for matingly engaging the guide block. The mating of the guide block with the guide slot at least prevents lateral movement of either the fixed or the movable portion relative to the corresponding other fixed or movable portion on the tool head.

BRIEF DESCRIPTION OF THE DRAWINGS

The above mentioned and other features of this invention and the manner of obtaining them will become more apparent, and the invention itself will be best understood by reference to the following description of the preferred embodiment of the invention in conjunction with the drawings, in which.

DETAILED DESCRIPTION OF THE PREFERRED EMBODIMENT

Figure 1:
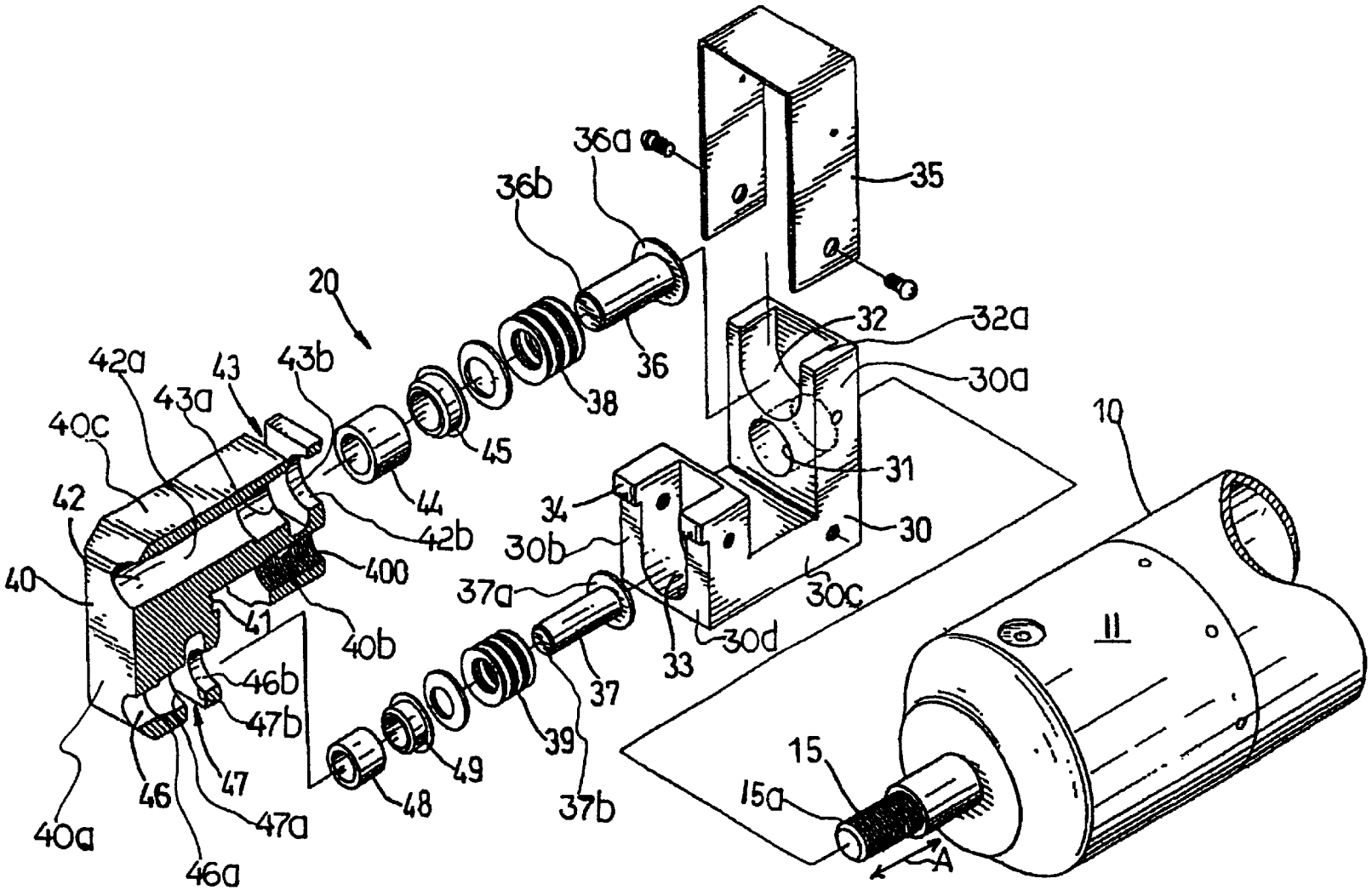
FIG. 1 is an exploded perspective view of a tool head of a pneumatic punch in accordance with the present invention.
Figure 2:
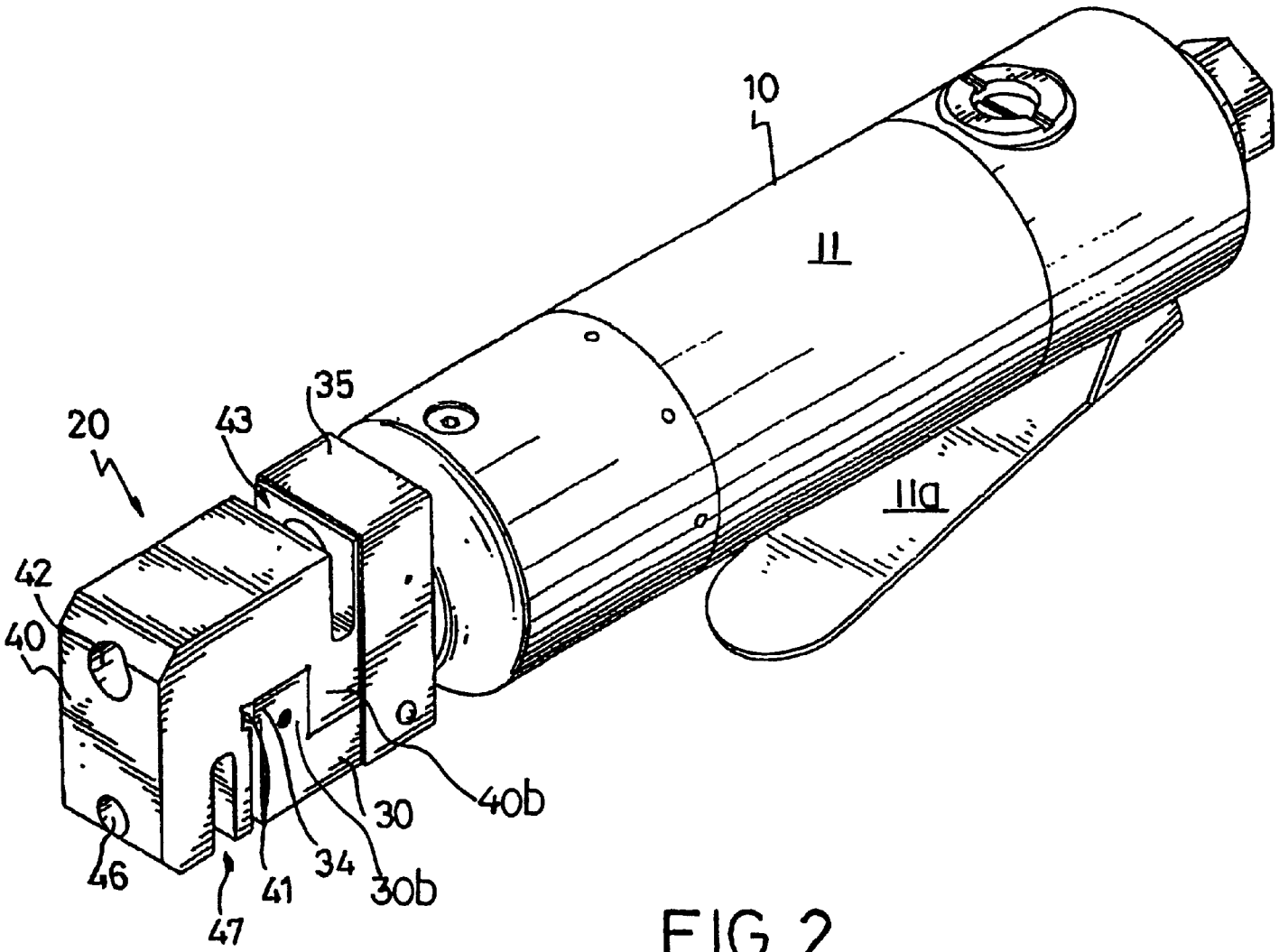
FIG. 2 is a perspective view of the tool head of the pneumatic punch in accordance with the present invention.

The above-listed objects are met or exceeded by the present tool head of a hand-held, hole punching device which has the following configuration. Referring to FIGS. 1 and 2, the present invention relates to a tool head 20 of a pneumatic punch 10. The pneumatic punch 10 has a movable shaft 15 reciprocating in an axial direction (shown by arrows A). The tool head 20 comprises a fixed portion or seat 30 secured with a cylindrical main body 11 of the pneumatic punch 10 and a movable portion or seat 40 secured on the movable shaft 15 of the pneumatic punch 10. A flat trigger 11*a* is attached to the exterior of main body 11. It will be appreciated that other structures for the main body 11 are also possible other than cylindrical such as a gun or pistol shape with a finger trigger rather than flat trigger 11*a*.

The fixed seat 30 has an upright J-shaped formation or member including a long sidewall 30*a*, a short sidewall 30*b*, and a bottom wall 30*c* extending between the long and short sidewalls. An aperture 31 is defined in the long sidewall 30*a* which is adjacent the pneumatic punch 10 and the movable shaft 15 extends therethrough. The long and short sidewalls 30*a*, 30*b* of the fixed seat 30 respectively define a first receiving recess 32 and a second receiving recess 33 therein. The fixed seat 30 also has an axially extending guide block 34 formed on the short sidewall 30*b* and on an end face 30d facing the movable seat 40. A top opening 32*a* of the first receiving recess 32 has a side cover 35 fixedly mounted thereon. A fixed end 36*a* of a first punch pin 36 and a fixed end 37*a* of a second punch pin 37 are respectively received in the first receiving recess 32 and the second receiving recess 33 with a first elastic element 38 and a second elastic element 39 respectively provided therearound. The elastic or resilient elements are preferably coil springs. Each punch pin preferably has a different diameter but could be unique in some other way, such as shape.

The movable seat 40 has an inverted J-shaped formation or member also with long sidewall 40*a*, short sidewall 40*b* and bottom wall 40*c*. The short sidewall 40*b* of the movable seat 40 is positioned so that the short sidewall 30*b* of the fixed seat 30 engages the short wall 40*b* to stop or impede the axial motion of the movable seat 40 as it moves away from the main body 11. This further prevents the release of the movable portion from the main body.

Referring again to FIG. 1, a screw hole 400 is defined in the movable seat 40 corresponding to the aperture 31 of the fixed seat 30. The movable shaft 15 has a threaded end 15*a* inserted through the aperture 31 of the fixed seat 30 and threadingly received in the screw hole 400 to secure the movable shaft 15 with the movable seat 40. The movable seat 40 defines a guide slot 41 corresponding to the guide block 34 of the fixed seat 30. A first discharging passage 42 is defined in the movable seat 40 corresponding to the first punch pin 36, and is in communication with the first transverse slot 43 which is defined in the movable seat 40 substantially perpendicular to the first discharging passage 42.

Figure 3:
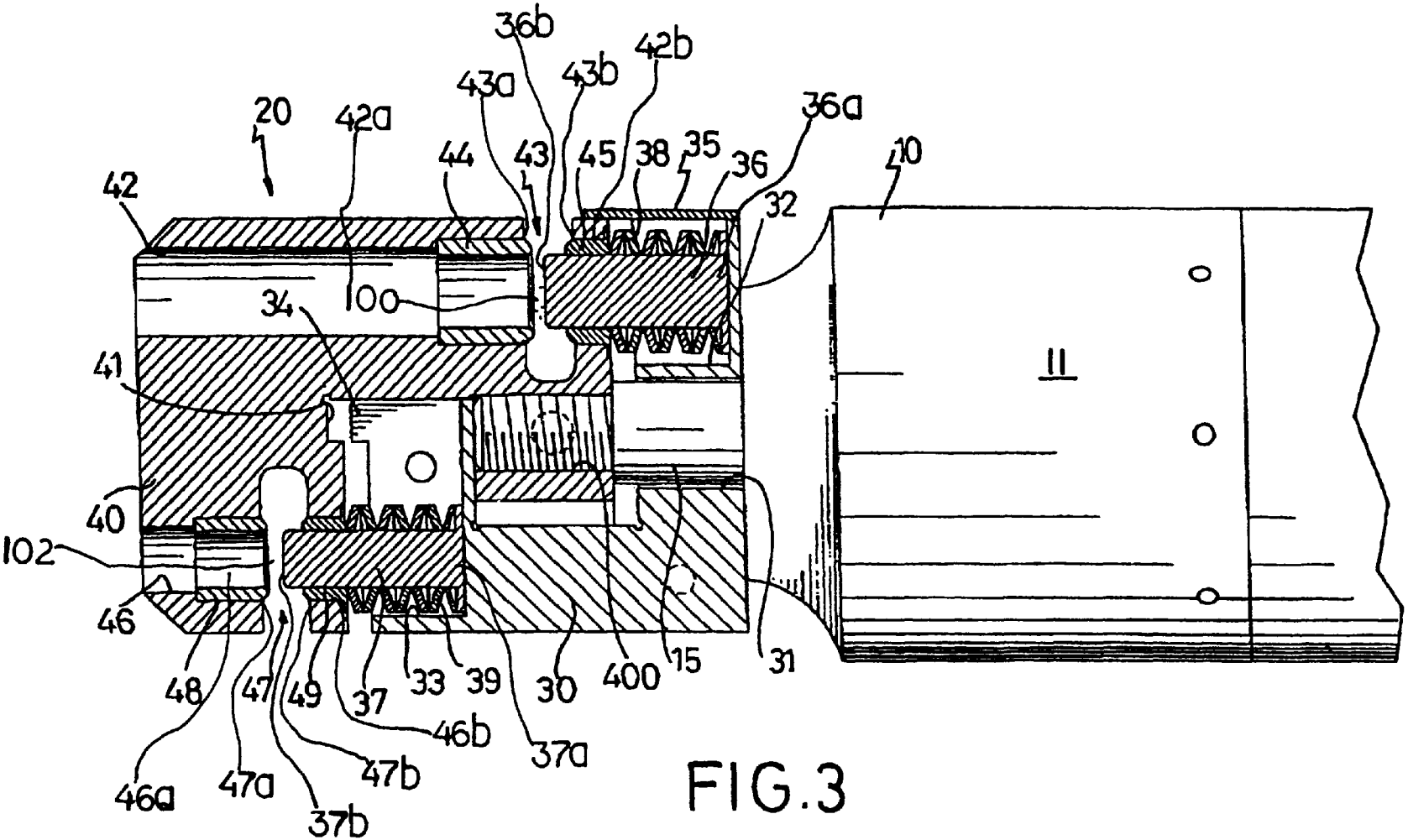
FIG. 3 is a cross sectional view of the tool head of the pneumatic punch in accordance with the present invention.

Referring now to FIGS. 1 and 3, the first discharging passage 42 is divided by the first transverse slot 43 into a long portion 42*a* and a short portion 42*b*, both portions 5 having a first opening 43*a*, 43*b* respectively. A second discharging passage 46 is defined in the movable seat 40 corresponding to the second punch pin 37, and is in communication with a second transverse slot 47 which is defined in the movable seat 40 substantially perpendicular to the second discharging passage 46. The second discharging passage 46 is divided by the second transverse slot 47 into a long portion 46*a* and a short portion 46*b*, both portions having a first entrance opening 47*a*, 47*b* respectively. The first discharging passage 42 has a first guide cylinder 44 and a second guide cylinder 45 respectively provided at the first openings 43*a*, 43*b* of the long and short portions 42*a*, 42*b*. The second discharging passage 46 also has a first guide cylinder 48 and a second guide cylinder 49 respectively provided at the first openings 47*a*, 47*b* of the long and short portions 46*a*, 46*b*.

Referring again to FIG. 3, the first and second elastic elements 38, 39 respectively press the movable seat 40 away from the fixed seat 30 for biasing the movable seat away from the fixed seat 30 to define space 100, 102 between the first guide cylinders 44, 48 and the corresponding second guide cylinders 45, 49 in order to allow sheet plates 104, 106 (shown in FIG. 4) to be inserted therein.

Figure 4:
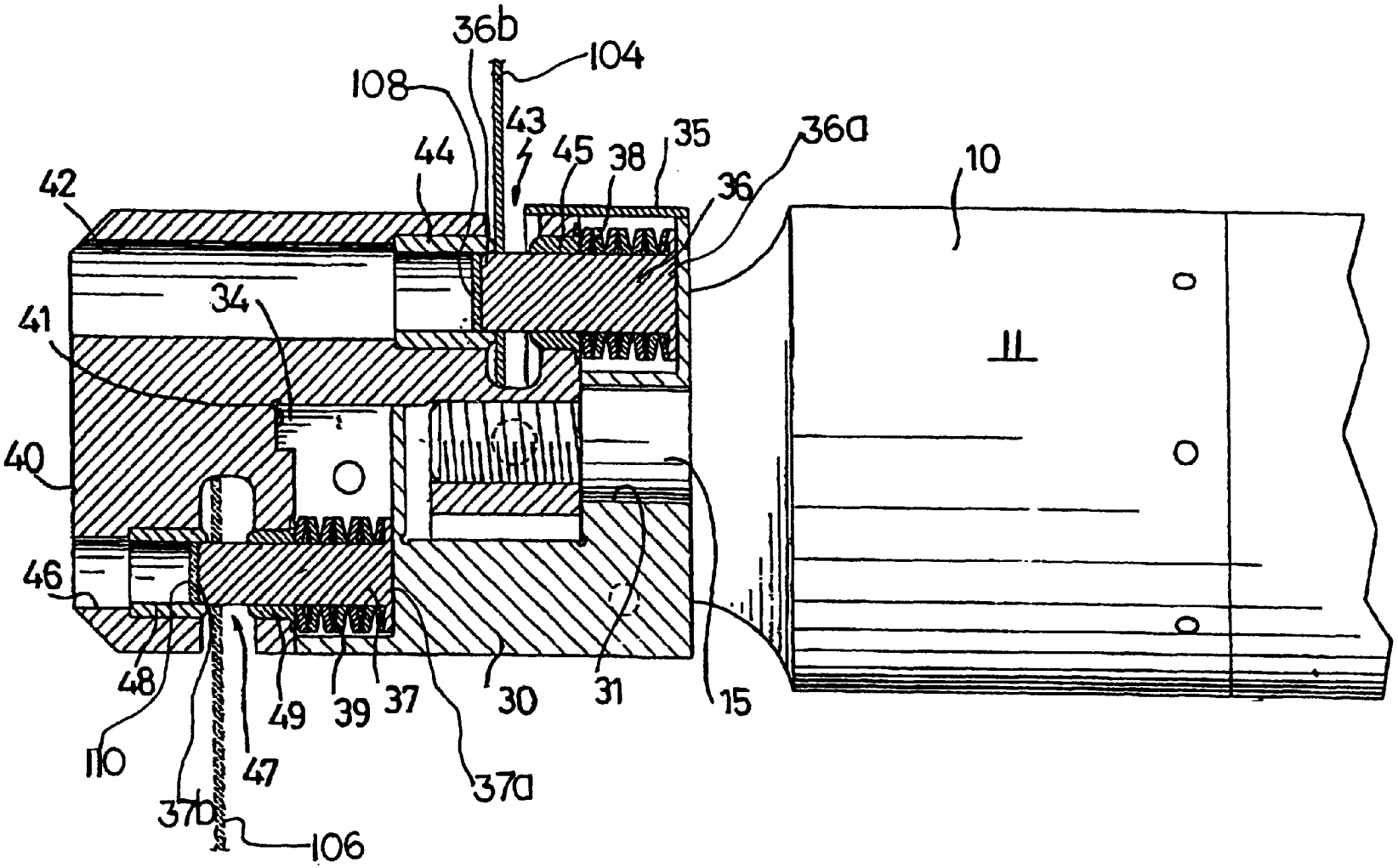
FIG. 4 is a cross sectional view of the tool head of the pneumatic punch in accordance with the present invention, showing its punching operation.
Figure 5:
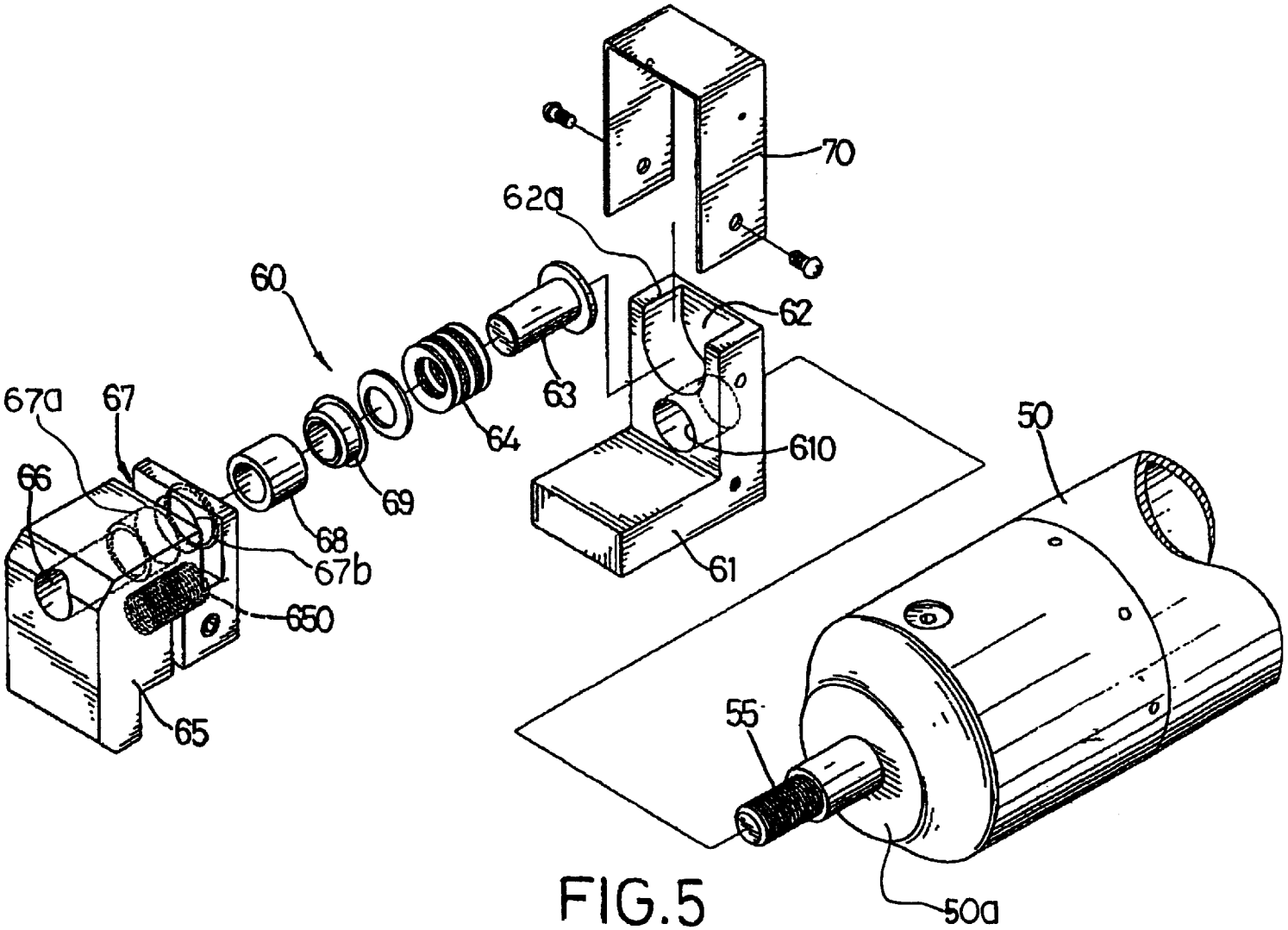
FIG.5 PRIOR ART
FIG. 5 is an exploded perspective view of a conventional tool head of a pneumatic punch.
Figure 6:
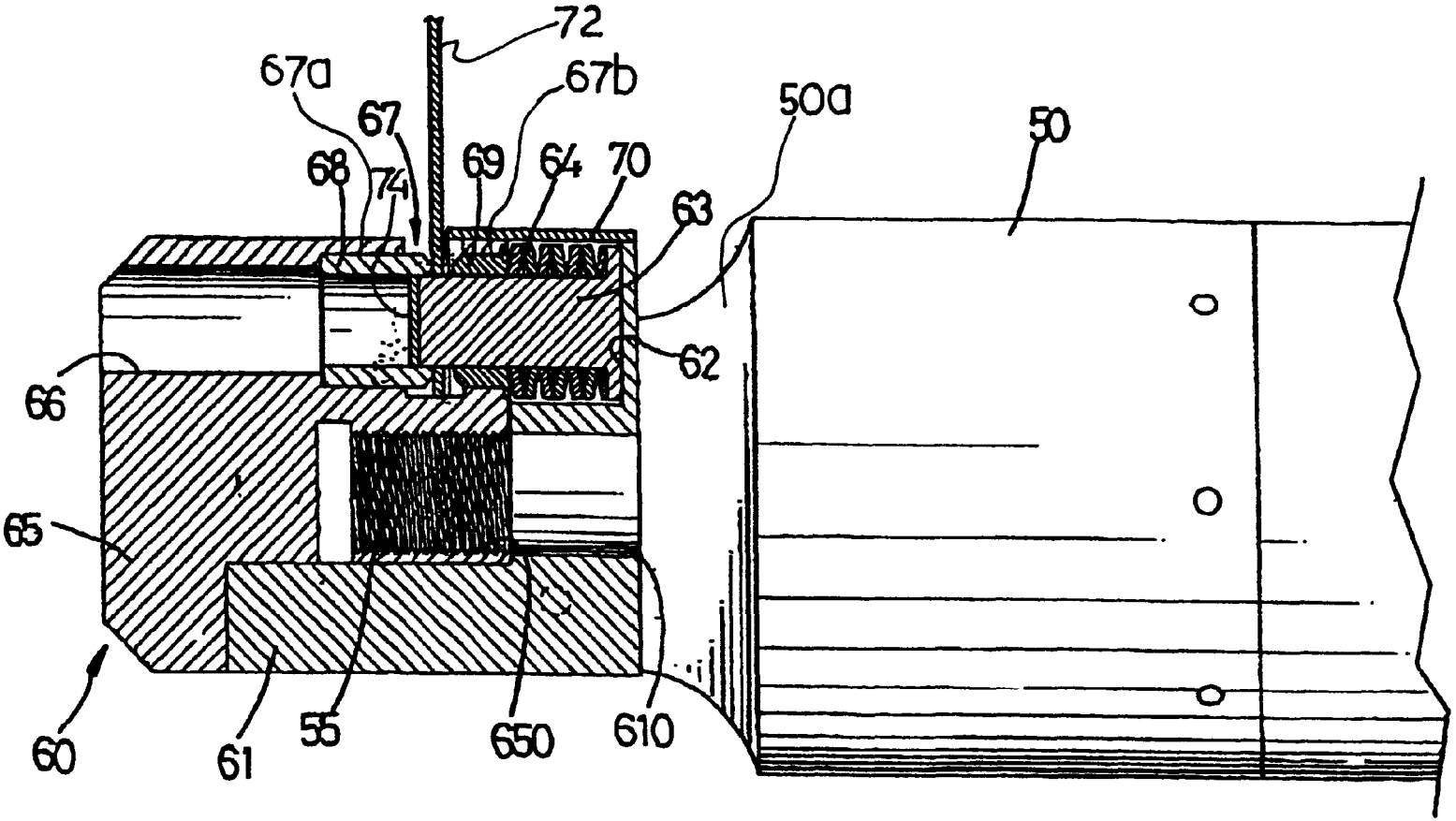
FIG. 6 PRIOR ART
FIG. 6 is a cross sectional view of the conventional tool head of the pneumatic punch.

Referring now to FIG. 4 either sheet plate 104 or 106 is inserted into its corresponding recess 43 or 47 as shown (the sheet plates are typically not inserted simultaneously and FIG. 4 depicts both sheets 104, 106 for illustrative purposes). Assuming sheet plate 104 is inserted into recess 43, when the pneumatic punch 10 starts operation, the 5 movable shaft 15 is retracted back toward main body 11. The movable seat 40, driven by the movable shaft 15, moves towards the fixed seat 30, and punching ends 36*b*, 37*b* of the punch pins 36, 37 are respectively inserted through the second guide cylinders 45, 49 into the first guide cylinders 44, 48, which in this example punches a hole in sheet plate 104. Since the sheet plate 104 is inserted into the first transverse recess 43, the sheet plate 104 is positioned between the first guide cylinder 44 and the second guide cylinder 45. The waste plate 108 punched off from the plate 104 is discharged via the discharging passage 42. The first elastic element 38 urges the moving seat 40 back to its pre-punching position. The pneumatic punch can then immediately be repositioned to punch a hole in plate 106 with the other punch pin 37, which has the same procedure as for plate 104 already described.

The many advantages of this invention are now apparent. A hand-held, hole punching device with a tool head that includes two hole punchers, each with a different size or type of punch pin, eliminates the need to replace the punch pin or provide a second hole punching device when different sizes or types of holes are required. After punching a hole of one size or type, the pneumatic punch 10 is simply repositioned to then punch a hole of a different size or type.

While various embodiments of the present invention have been described, it should be understood that other modifications, substitutions and alternatives may be apparent to one of ordinary skill in the art. Such modifications, substitutions and alternatives can be made without departing from the spirit and scope of the invention, which should be determined from the appended claims.

What is claimed is:

1. A tool head of a hand held pneumatic punch which has a main body and a movable shaft movable in an axial direction, said toll head comprising:

a fixed seat secured to the main body; and a movable seat secured to the movable shaft;

wherein said fixed seat comprises an upright J-shaped member with a first sidewall and a second sidewall, and defines an aperture in the first sidewall to permit the movable shaft to extend therethrough, and has a first receiving recess and a second receiving recess respectively defined in the first and second sidewalls, a first and a second punch pin are respectively received in the first and the second receiving recess with two resilient elements respectively provided therearound, and wherein said movable seat comprises an inverted J-shaped member mated with the fixed seat, said movable seat defining:

a screw hole therein corresponding to the aperture of the fixed seat so that the screw hole threadingly receives a threaded end of the movable shaft that extends through the aperture of the fixed seat;

a first discharging passage and a second discharging passage corresponding to the first and second punch pins respectively, the first discharging passage having a first guide cylinder and a second guide cylinder, the second discharge passage having a first guide cylinder and a second guide cylinder;

a first transverse slot substantially perpendicular to the first discharging passage and in communication with the first discharging passage; and a second transverse slot substantially perpendicular to the second discharging passage and in communication with the second discharging passage.

2. The tool head of the pneumatic punch as claimed in claim 1, wherein the fixed seat includes a guide block formed on an end face of the second sidewall and extends toward the movable seat, the movable seat further defining a guide slot corresponding to the guide block.

3. The tool head of the pneumatic punch as claimed in claim 1, wherein the fixed seat has a side cover securely mounted at a top opening of said first receiving recess.

4. A hand held, hole punching device, comprising:

a shaft;

a main body having a device for axially moving said shaft in a reciprocating motion; and a tool head connected to said shaft, said tool head including:

a fixed portion fixed to said main body and for slidably engaging said shaft so that said shaft is permitted to slide axially relative to said fixed portion; and a movable portion fixed to said shaft so that said movable portion moves axially with said shaft, said movable portion and said fixed portion cooperatively defining at least two hole punchers, wherein each said hole puncher has a punch pin that is different from a punch pin of any other said hole puncher on said tool head.

5. The hole punching device of claim 4, wherein said punch pins each have a different diameter.

6. The hole punching device of claim 4, wherein said fixed portion is configured with a generally upright J-shaped formation and said movable portion is configured with a generally inverted J-shaped formation, said fixed and movable portions being disposed so that said fixed portion impedes axial motion of said movable portion.

7. The hole punching device of claim 4, wherein said fixed portion further defines an aperture for slidably engaging said shaft for allowing said shaft to axially slide through said fixed portion, and said movable portion further defines a hole for threadedly engaging a threaded end of said shaft.

8. The hole punching device of claim 4, wherein said at least two hole punchers include a first hole puncher with a first punch pin, and a second hole puncher with a second punch pin, each said punch pin having a punching end and a fixed end, said first hole puncher further having a first recess defined by said fixed portion for receiving said fixed end of said first punch pin and holding a first resilient member, and a first discharge passage defined by said movable portion and opposed to said punching end of said first punch pin for receiving first discharged material from said first punch pin, and said second hole puncher further having a second recess defined by said fixed portion for receiving said fixed end of said second punching pin and holding a second resilient member, and a second discharge passage defined by said movable portion and opposed to said punching end of said second punch pin for receiving second discharged material from said second punch pin, wherein said resilient members are configured and disposed to abut said movable portion so that said resilient members bias said movable portion away from said fixed portion in a position for receiving or releasing material to be punched.

9. The hole punching device of claim 4, wherein said fixed portion further includes an axially extending guide block; and wherein said movable portion firer includes an axially extending guide slot configured and disposed for matingly engaging said guide block, wherein said mating of said guide block with said guide slot at least prevents lateral movement of either said fixed or said movable portion relative to the other said fixed or said movable portion.

10. The hole punching device of claim 4, wherein said movable portion further defines a first transverse slot for said first hole puncher and a second transverse slot for said second hole puncher, each said transverse slot dividing a corresponding said discharge aperture into a long portion and a short portion, said short and long portions further having guide cylinders for slidably engaging said punch pins, at least one guide cylinder being position on each said long and said short portions.

11. A tool head of a hand held hole punching device with a main body and a shaft axially extending from the main body, comprising:

a fixed portion for slidably engaging the shaft so tat said fixed portion permits said shaft to slide axially relative to said fixed portion; and a movable portion fixed to said shaft so tat said movable portion moves axially with said shaft, said movable portion and said fixed portion cooperatively defining at least two hole punchers, wherein each said hole puncher has a punch pin that is different from a punch pin of any other said hole puncher on die tool head.

12. The tool head of claim 11, wherein said fixed portion is configured with a generally upright J-shaped formation and said movable portion is configured with a generally inverted J-shaped formation, said fixed and movable portions being disposed so that said fixed portion impedes axial motion of said movable portion.

13. The tool head of claim 11, wherein said fixed portion further defines an aperture for slidably engaging said shaft for allowing said shaft to axially slide through said fixed portion, and said movable portion further defines a hole for threadedly engaging a distal end of said shaft.

14. The tool head of claim 11, wherein said at least two hole punchers includes a first hole puncher with a first punch pin, and a second hole puncher with a second punch pin, each said punch pin having a punching end and a fixed end, said first hole puncher further having a first recess defined by said fixed portion for receiving said fixed end of said first punch pin and holding a first resilient member, and a first discharge passage defined by said movable portion and opposed to said punching end of said first punch pin for receiving first discharged material from said first punch pin, and said second hole puncher further having a second recess defined by said fixed portion for receiving said fixed end of said second punching pin and holding a second resilient member, and a second discharge passage defined by said movable portion and opposed to said punching end of said second punch pin for receiving second discharged material from said second punch pin, wherein said resilient members are configured and disposed to abut said movable portion so that said resilient members bias said movable portion away from said fixed portion in a position for receiving or releasing material to be punched.

* * * * *

UNITED STATES PATENT AND TRADEMARK OFFICE

CERTIFICATE OF CORRECTION

PATENT NO. : 6,401,345 B1
DATED : June 11, 2002
INVENTOR(S) : Jian-Shiou Liaw

It is certified that error appears in the above-identified patent and that said Letters Patent is hereby corrected as shown below:

Column 3,
Line 41, delete “5”.

Column 4,
Line 3, delete “5”

Column 6,
Line 1, delete “firer” insert -- further --.
Lines 19 and 22, delete “tat” insert -- that --.
Line 28, delete “die” insert -- the --.

Signed and Sealed this

Twentieth Day of May, 2003

JAMES E. ROGAN
*Director of the United States Patent and Trademark Office*